United States Patent [19]

Nakamura et al.

[11] Patent Number: 4,764,426

[45] Date of Patent: Aug. 16, 1988

[54] POLYESTER FIBER AND PRODUCTION THEREOF

[75] Inventors: Ryoji Nakamura; Masakatsu Ohguchi, both of Otsu, Japan

[73] Assignee: Toyo Boseki Kabushiki Kaisha, Osaka, Japan

[21] Appl. No.: 54,955

[22] Filed: May 27, 1987

[30] Foreign Application Priority Data

May 27, 1986 [JP] Japan ..... 61-121971

[51] Int. Cl.[4] ..... D02G 3/00

[52] U.S. Cl. ..... 428/400; 428/364; 428/372

[58] Field of Search ..... 428/372, 376, 398, 400, 428/364; 264/41, 48, 49

[56] References Cited

U.S. PATENT DOCUMENTS 4,254,182 3/1981 Yamaguchi et al. ..... 428/400 X
4,356,234 10/1982 Kumakawa et al. ..... 428/400 X
4,361,617 11/1982 Suzuki et al. ..... 428/400 X
4,400,424 8/1983 Hatada et al. ..... 428/400 X
4,451,534 5/1984 Akagi et al. ..... 428/400 X
4,522,873 6/1985 Akagi et al. ..... 428/400 X

FOREIGN PATENT DOCUMENTS 59-228014 12/1984 Japan ..... 428/400
61-102415 5/1986 Japan ..... 428/400

*Primary Examiner*—Lorraine T. Kendell
*Attorney, Agent, or Firm*—Wenderoth, Lind & Ponack

[57] ABSTRACT

A polyester synthetic fiber containing rigid microgrooves, in which there is a ridge-like portion between adjacent microgrooves, said microgrooves being substantially continuous in the axial direction of the fiber, and which microgrooves are arranged nearly regularly on the surface of the polyester fibers said microgrooves and ridges having microcraters distributed upon the surfaces thereof. The polyester fibers have a dry feel and a silk-like hand and possess excellent deep-color dyability.

5 Claims, 2 Drawing Sheets

POLYESTER FIBER AND PRODUCTION THEREOF

The present invention relates to a polyester fiber having a dry feel and a silk-like hand, and having excellent deep color dyeability and more particularly to a polyester synthetic fiber, whose surface forms ridged microgrooves (this expression means that there is a ridge-like portion between adjacent microgrooves) substantially continuous in the axial direction of the fiber and are arranged nearly regularly, and on said rigded microgrooves, there are distributed microcraters, and to a method of producing the same.

Polyester fibers have smooth surfaces in comparison with other fibers such as acetate, rayon, wool, silk, etc. and therefore they have defects in that it is difficult to obtain deep color dyeability effect, and moreover they are waxy, non-water-absorptive, and apt to be charged with static electricity.

A large number of techniques are known to improve the above-mentioned properties characteristic of polyester fibers. For example, from Japanese Patent Publication No. 24233/84, is known a synthetic polyester fiber which has irregularly rugged random surfaces and further has ultrafine unevennesses in the rugged portions forming the random surfaces. Also, from Japanese Patent Kokai No. 99400/77, is known a synthetic fiber having microgrooves regularly given on the fiber surface in the direction at right angles to the fiber axis, by means of plasma irradiation. Furthermore, from Japanese Patent Kokai No. 192716/84 (U.S. Pat. No. 4,600,743) is known a method of melt spinning of a fiber-forming polymer to which a small quantity of polyoxyalkylene glycol or a derivative thereof is added as a means of improving the antistatic properties of polyester fabrics, by using a large orifice diameter spinneret of which the open area of a single spinning orifice is 0.2 $mm^2$ or larger. Moreover, from Japanese Patent Kokai No. 143541/82, it is known to improve the antistatic properties and color developing properties of a fabric by blending two kinds of fibers, namely a polyester fiber having fine surface ruggednesses and a polyester fiber containing a hydrophilic polymer in the form of streaks. However, by any of the above-mentioned known techniques, it is impossible to improve many of the properties of polyester fibers at the same time, though a part of their defects can be remedied. Therefore, it is the present situation that there is a widespread desire for the advent of a polyester fiber satisfying especially the dry feel, silk-like hand, deep color dyeability, and preferably the antistatic prperties at the same time.

The characteristics of silk fabrics consist in satisfying the hand characteristics including drape properties, resiliency, etc. and the frictional characteristics such as dry touch, creaking feel, scrooping sound, etc. at the same time. The drape properties depend on the degree of freedom at the crossing points of warp and weft yarns of fabric structure. and it is desirable that the contacting pressure is low and the frictional force at the crossing points is small. The resiliency is governed by the Young's modulus of the fiber and the liability of the mutual movement of the fiber in the fiber axis direction. The frictional force of silk is low in the fiber axis direction and when the fibers are crossed perpendicular to one another, whereas it is high only in directions at right angles to the fiber axis, and this forms the cause of the creaking and scropping sound.

The fiber having rondom ruggednesses uniformly on the fiber surface as seen in the above-mentioned Japanese Patent Publication No. 24233/84, causes a decrease of the frictional force in every direction, thus producing an improving effect in the touch, but it is impossible to expect the creaking feel, dry touch, and scrooping sound effect. In the case of the fiber having microgrooves formed on the fiber surface in directions at right angles to the fiber axis as seen in the above-mentioned Japanese Patent Kokai No. 99400/77, the frictional force in the fiber axis direction becomes high. Thus, although some degree of improvement in touch and scrooping effect can be expected, the mutual movement of the fibers in the fiber axis becomes restricted and the resiliency is worsened on the contrary. Therefore, this is not a means that can improve the feel and hand at the same time.

Further, when the method of the above-mentioned Japanese Patent Kokai No. 192716/84 is used, the liability to electric charge, which is a defect of synthetic fibers, can be remedied to give an excellent antistatic properties, but no improvement can be obtained on the dry touch, deep color dyeability and silk-like hand effect.

Also, by following the above-mentioned Japanese Patent Kokai No. 143541/82, the antistatic properties and color developing properties of fabrics made of polyester fibers can be improved, but in this case, it is required to produce two kinds of fibers having different characteristics and to blend and combine them. Such a method complicates the process, and fails in improving the numerous properties of single-component fibers.

The object of the present invention is to solve all the problems which have not been attained by the above-mentioned prior techniques and also to provide a fiber removed from the waxy feel of polyester fibers and brought most close to the character of silk both in color dyeability and in hand feel characteristics at the same time. According to neccesity, the present invention provides also a polyester fiber which can satisfy the antistatic properties at the same time, and a method of producing the same.

Briefly, the present invention have the following two main aspects:

(1) A polyester synthetic fiber characterized by ridged microgrooves formed on the whole surface of the fiber and which extend substantially continuously in the axial direction of the fiber and are arranged nearly regularly, the distance between the respective substantially longitudinal center lines of adjacent microgrooves being 0.3–0.9 micron as measured as a flat plane distance along the circumferential direction at right angles to the fiber axis, the microgrooves existing 7–30 in number per 10 microns of the plane distance along the circumference at right angles to the fiber axis, there being distributed microcraters on the ridges and microgrooves, said microcraters having a width of 0.05–0.4 micron.

(2) A method of producing a polyester synthetic fiber characterized by melt-spinning a polyester containing internally grown fine particles and/or externally added fine particles and a quantity not less than 0.5 weight % of a water-soluble high polymer of the class of polyoxyalkylene glycol or a derivative thereof, stretching the resulting filaments, and subjecting the filaments to a peeling treatment (or a weight decreasing treatment) with a solvent or decomposing agent for said fiber.

The polyesters used in the present invention are those composed of units of terephthalic acid or its ester-forming derivatives as the main acid component and units of ethylene glycol as the main glycol component. The polyesters may contain as acid components, less than 20 mol % of an aliphatic dicarboxylic acid such as oxalic acid, malonic acid, maleic acid, glutaric acid, adipic acid, sebacic acid, 1,4-cyclohexane dicarboxylic acid, 2,5-norbornane dicarboxylic acid, etc. or their ester-forming derivatives, and an aromatic dicaboxylic acid such as phthalic acid, isophthalic acid, 5-(alkali-metal)-sulfoisophthalic acid, diphenic acid, 1,4-naphthalene dicarboxylic acid, 2,6-napththalene dicarboxylic acid, 1,2-bis(phenoxy)ethane-p,p'-dicarboxylic acid, etc. or their ester-forming derivatives, as a copolymerization component. The polyesters may also contain an oxycarboxylic acid such as p-(2-hydroxyethyoxy)benzoic acid or its ester-forming derivative, in a quantity of less than 20 mol % of the acid component.

The polyesters may contain as a glycol component, less than 20% of propylene glycol, diethylene glycol, neopenthyl glycol, 1,4-butanediol, 1,6-hexanediol, 1,4-cyclohexanedimethanol, 1,10-decamethylene glycol, 4,4-dihydroxybisphenol, 1,4bis(β-hydroxyethoxy)benzene, 2,5-naphthalenediol, glycols formed of the above-mentioned glycols to which ethylene oxide has been added, polyethylene glycol, etc.

BRIEF DESCRIPTION OF THE DRAWINGS

The present invention will be explained in more detail by referring partly to the accompanying drawings wherein

In FIGS. 3 and 4, the numerals indicated by 1, 2 and 3 designate warp-warp, weft-weft and warp-weft, respectively.

Figure 1:
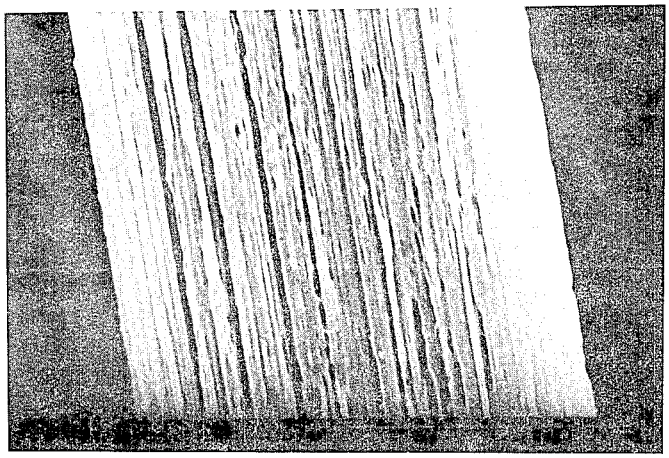
FIG. 1 is a scanning electron microscopic photograph of 5,000 times magnification, showing a side surface of the fiber of the present invention obtained in Example 1.
Figure 2:
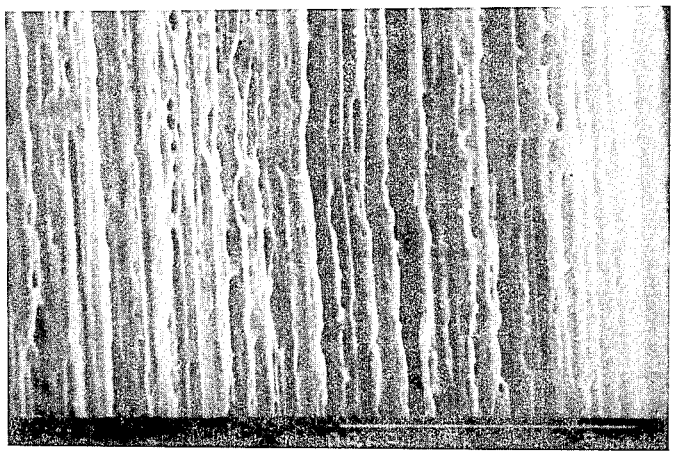
FIG. 2 is a scanning electron microscopic photograph of 10,000 times magnification, showing a side surface of the fiber of the present invention obtained in Example 1.

As apparent from FIGS. 1 and 2, on the surface of the fiber, are formed ridged microgrooves extending substantially continuously in the fiber axis direction and arranged nearly regularly. Said ridged microgrooves satisfy a distance between centers of adjacent microgrooves of 0.3–0.9 micron measured as a flat plane distance along the circumferential direction at right angles to the fiber axis. The length that can be confirmed by observing said ridged microgrooves in the fiber axis direction continuously is at least 80 microns, preferably more than 150 microns. Therefore, it is judged that said ridged microgrooves are substantially continuous.

A distance between centers of adjacent microgrooves can be obtained by determining the plane distance between adjacent microgrooves from a scanning electron microscopic photograph of 5,000 times magnification as shown in FIG. 1 taken at right angles to the fiber axis, and the distance is obtained by averaging measured values at more than 50 places. On the ridges and grooves of the ridged microgrooves observed by magnifying the fiber surface 10,000 times, existence of microcraters having a width of 0.05–0.4 micron is observed.

As used herein the term "the greatest width of a microcrater" is construded to have the meaning of the greatest size of a microcrater measured in the direction of right angles to the fiber axis.

Further details about such a microcrater are as follows:

A microcrater is such that, when the length of the microcrater in the width direction is expressed as D and the length in the long axis direction is expressed as L, it has a ratio L/D of less than 10.

The gist of the present invention consists in forming, on the fiber surface, anisotropic ridged microgrooves arranged nearly regularly, thereby to add anisotropy to the frictional properties of the fiber surface.

In addition to said ridged microgrooves extending continuously in the fiber axis direction and arranged nearly regularly, it is necessary to form microcraters distributed on the microgrooves and ridges. When the distance between centers of adjacent microgrooves is less than 0.3 micron, the friction-increasing effect in the direction at right angles to the fiber axis is little, and the improving effect on the dry touch feel is also little. When the distance is larger than 0.9 micron, the fiber luster becomes metallic. Therefore, such distances are undesirable.

The length of the ridged microgrooves is not particularly defined, but it is desirable that it is more than 80 microns, preferably more than 150 microns.

When the length of the ridged microgrooves is less than 80 microns, the fiber is liable to fibrillation when it undergoes peeling treatment. This worsens the appearance, and decreases the frictional anisotropy of the fiber surface, and therefore it is impossible to simultaneously satisfy the hand feel and dry touch feel effects of the present invention.

In order to satisfy the dry touch feel effect of the present invention, it is necessary to heighten the warp-warp frictional force between cloth and cloth. For this purpose, in the case of a plain weave fabric for example, it is necessary that the shortest length of the warps of the fabric that can appear on the surface of the fabric in relation with the wefts crossing with the warps, should be more than 10% of twice the interval between the warps (about 500 microns). From this fact, the longer the lengh of the ridged microgrooves, the better is for heightening of the frictional force, and the length is desirably more than 80 microns, and especially more than 150 microns. By the present invention, it is revealed that as the length of the ridged microgrooves becomes longer continuously in the fiber axis direction, a better dry feeling effect can be obtained.

The microgrooves of the continuous ridged microgrooves obtained by the present invention have relatively sharp edges and it is considered that this fact also contributes to the improvement of the feeling effect.

The depth of the microgroove from the surface is not particularly limited. However, according to our knowledge, the depth of the microgroove is about 0.8–1.5 times the width of the microgroove, and when the depth becomes more than twice the width of the microgroove, light paths through the fibers are considered to be hindered, and this leads to a decrease of the deep color dyeability effect. We have confirmed this fact experimentally.

By the further existence of microcraters distributed on the microgrooves and ridges, milder luster and a deep color effect of deep dyed products are obtained, and at the same time the frictional force of the fiber surface is also improved. That is to say, when fibers are crossed perpendicular to one another and rubbed, or when they are rubbed with one another in the direction of the fiber axis, the frictional force is decreased, and only when fibers are rubbed with one another in the direction at right angles to the fiber axis, the frictional force is increased. The size of the mcrocraters distributed on the ridged microgrooves extending substantially continuously in the fiber axis direction, is desirably of the order of the wave lengths of visible light, from the viewpoint of the luster and deep coloring properties. However, considering that the continuous layers of any antistatic agent may not be divided into parts, the largest width of the microcrater is required to be 0.05–0.4 micron. The number of the microcraters is not particularly limited, but they desirably cover the fiber surface uniformly.

It is desirable that its shape is narrow and long lengthwise in the fiber axis direction in order to more emphasize the frictional anisotropy of the fiber surface. The density of the ridged microgrooves continuing in the fiber axis direction is necessary to be at least 7 per 10 microns in the direction at right angles to the fiber axis for the purpose of improving the dry touch feeling effect. When the number exceeds 30, the dry touch feeling effect decreases and therefore the object of the present invention can not be attained.

In the following, the method of producing the fiber of the present invention will be explained.

In the present invention, it is necessary to form on the fiber surface, ridged microgrooves extending substantially continuously in the fiber axis direction and arranged nearly regularly, and further to form secondary microcraters on said ridged microgrooves.

In order to form the above-mentioned surface shape, it is necessary to melt-spin a polyester containing internally grown fine particles and/or externally added fine particles and more than 0.5 weight % of a water-soluble high polymer of the class of polyoxyalkylene glycol or its derivative, then stretch the resulting filaments and subject the filaments to peeling treatment with a solvent or decomposing agent for the fiber. As used in the present invention, the term "internally grown fine particles" means fine particles generated by the reaction of compounds added at any stage before the synthesis of the polyester is completed during the production of the polyester. As such fine particles are mentioned combinations of zirconium compounds and phosphorus compounds.

Any zirconium compounds can be used as long as they are soluble in the reaction system. Representative compounds include zirconium alkoxides such as tetra-n-propiozirconate, tetra-isopropiozirconate, tetra-n-butyl zirconate, tetra-n-amyl zirconate, etc.; organic acid zirconyl salts such as zirconyl acetate, zirconyl formate, zirconyl tartrate, zirconyl oxalate, zirconyl stearate, zirconyl benzoate, etc.; and inorganic acid zirconyls such as zirconyl chloride, zirconyl bromide, ammonium zirconyl carbonate, etc.

It is desirable that the quantity of these zirconium compounds to be added should be defined within the range of 80–2500 ppm calculated in terms of zirconium atom, based on the generated polyester. A quantity of addition less than 80 ppm is not desirable, since at such a quantity the generated quantity of the fine particles becomes small and no improving effects in deep color dyeability and hand feel can be obtained. On the other hand, when the quantity exceeds 2500 ppm, the deep color dyeability reaches saturation, and coarse particles are generated. Such coarse particles form a cause of increased back pressure and in addition worsen the polymer color. Therefore such a quantity is also undesirable. A particularly preferable quantity to be added ranges from 200 to 1500 ppm. The zirconium compounds may be added in any form of solid or liquid. However, in order to disperse the resulting particles uniformly, it is most desirable to add them as a polyoxyalkylene glycol solution. When adding in the form of solid, it is recommended to add them to the reaction system after enclosing them in a container made of polyester.

Phosphorus compounds have a characteristic effect of regulating the concentration and size of the particles separated out by the zirconium compounds, and are one of the most characteristic components in the present invention together with zirconium compounds.

As such phosphorus compounds, those of pentavalent compounds are favorable, and more favorable ones are phosphoric acid, phosphonic acid and derivatives of these. Specific examples include phosphoric acid, alkali-metal salts of phosphoric acid, phosphoric acid trimethyl ester, phosphoric acid triethyl ester, phosphoric acid tributyl ester, phosphoric acid triphenyl ester, phosphoric acid monomethyl ester, phosphoric acid dimethyl ester, phosphoric acid monooethyl ester, phosphoric acid diethyl ester, phosphoric acid monobutyl ester, phosphoric acid dibutyl ester, phosphonic acid, alkali-metal salts of phosphonic acid, methyl phosphonic acid, methylphosphonic acid dimethyl ester, phenylphosphonic acid dimethyl ester, benzenephosphonic acid diethyl ester, phenylphosphonic acid diphenyl ester, diethylphosphonoethyl propionate, etc. These may be used singly or in combination of two or more kinds. The use of two kinds in combination is preferable since it widens the controlling range of particle diameters.

As mentioned above, these phosphorus compounds control the concentration and particle diameter of the insoluble particles formed by zirconium compounds, so that the quantity of these compounds to be added should be decided in relation with the quantity of zirconium to be added. It has been experimentally confirmed that by deciding the quantity of addition in the range of a molar ratio of Zr/P of 0.5–2.5, the effect of addition of phoshoric compounds can be effectively displayed. However, when the quantity of phosphorus compounds is too small, it is impossible to make the insoluble particles formed in the polymer sufficiently fine, so that the deep color dyeability effect of the final product becomes insufficient and moreover the stability of the polymer is lowered. Therefore too small a quantity of phosphoric compounds is undesirable. On the other hand, too large a quantity decreases the polymerization speed and entails an industrial disadvantage. Furthermore, such a quantity lowers the softening point and stability of the polymer, so that is is also undesirable.

As in the case of zirconium, the time of addition of phosphorus compounds may be any time before the completion of the polyester synthesis, but it is desirable to add on or after the completion of the esterification reaction, the first stage reaction, with a view to decreasing the formation of ether linkages. From the same reason, it is desirable to add after the addition of zirconium compounds.

The externally added fine particles as referred to in the present invention are not particularly limited, and they include for example, kaolin, talk, calcium carbonate, magnesium hydroxide, barium sulfate, silica, aluminum oxide, calcium hydroxide, etc.

As used in the present invention, the water-soluble high polymers of the class of polyoxyalkylene glycol or its derivatives (hereinafter referred to as POG) include, for example, polyethylene glycol, polypropylene glycol, random or block copolymers of ethylene oxide with propylene oxide, polytetramethylene glycol, block copolymers of polytetramethylene glycol with ethylene oxide added thereto, polyoxyalkylene compounds with hydroxyl groups at both terminals like addition compounds of ethylene oxide to neopentyl glycol or bisphenolic glycols; polyoxyalkylene compounds blocked with intervention of an ether bond(s) at one or both terminal position(s) such as monophenoxypolyethylene glycol, nonylphenoxypolyethylene glycol, sodium sulfophenoxypolyethylene glycol, diphenoxypolyethylene glycol, and a compound constituted with two molecules of monophenoxypolyethylene glycol and one molecule of tolylene diisocyanate; polyether compounds esterified at one or both terminal positions such as polyethylene glycol laurate, polyethylene glycol phosphate or its partial alkali salt and polyethylene glycol phosphonate or its partial alkali salt; block copolymers of polyethylene glycol with polyethylene terephthalate, block copolymersers of polytetramethylene glycol with polyethylene terephthalate or polybutylene terephthalate, block copolymers of polyethylene glycol with polycapromide, polyethylene glycol cyanoethylated at one or both terminal positions and its aminated product obtained from the reduction of the cyano group, addition products of ethylene oxide to primary or secondary alkylamines, copolymers of terephthalic acid and ethylene glycol with 5-sodium sulfoisophthalic acid or its derivative, and copolymers of ethylene oxide with an addition product of ethylene oxide to ethylene oxide, etc. Of course, the POG in the present invention is not limited to the above-mentioned specific examples, and may be a single compound or a mixture of two or more compounds.

The POG used in the present invention may be those as mentioned above. The POG to be added to the polyester may be mixed beforehand with any additive such as an antioxidant, ultraviolet ray absorber, pigment, organic or inorganic ionic compound, When the quantity of POG to be added is less than 0.5 weight %, it is impossible to observe clearly ridged microgrooves extending substantially continuously in the fiber axis direction and arranged nearly regularly, on the fiber surface after peeling treatment and therefore the dry touch feeling cannot be obtained.

Consequently, the quantity of POG to be added to the fiber-forming thermoplastic polymer should be more than 0.5 weight %, and preferably more than 0.1 weight % for the purpose of obtaining not only the dry touch feeling but also antistatic effect. The upper limit of the content of POG is not particularly limited in the present invention. However, since with the decrease of the content of POG, the light-resistance of dyed fibers obtained worsens, it is necessary to suitably select the upper limit of the content of POG within a range in which the light-resistance causes no problem in practical use. According to our knowledge, the upper limit differs depending on the kind of POG, the molecular weight of POG, whether a light-resistance improver is used in combination or not. In general, when the content of POG exceeds about 7 weight %, the decrease of the light-resistance becomes remarkable. Therefore, about 7 weight % is usually the standard of the upper limit of the POG content. But the occurrence of the ridged microgrooves extending long continuously becomes more remarkable with the increase of the POG content. Therefore, in practice, the content of POG should be decided according to the purpose and use of the fiber obtained, taking into consideration both the formation of longer ridged microgrooves and a better light-resistance.

In the production of the fiber of the present invention, the method of addition of POG to the polyester is not limited when the addition is conducted before spinning. The addition may be conducted at any time from the early stage of the polymerization of the thermoplastic polymer to the stage immediately before spinning.

In the present invention, a stretched polyester fiber is obtained by stretching a fiber resulting from melt-spinning of a polyester, to which has been added a water-soluble high polymer of the class of polyoxyalkylene glycol or a derivative thereof in which the above-mentioned internally grown fine particles and/or externally added fine particles are insoluble and which is insoluble in the polyester but has higher solubility in a solvent or decomposing agent for the fiber than the polyester. The melt-spinning conditions are not particularly limited and any method may be employed as far as the conditions lie within the following range:

| | |
|---|---|
| Spinning temperature | 275–290° C. |
| Extruded quantity per single orifice | 0.5–3.0 g/min. |
| Diameter of a spinning orifice | 0.2–1.5 mm |
| Spinning velocity | 600–8000 m/min. |

In order to improve not only the antistatic properties but also the dry touch feeling by forming on the fiber surface, particularly long ridged microgrooves extending substantially continuously in the fiber direction, it is advisable to satisfy the following melt-spinning conditions. That is to say, a spinneret for producing solid fibers having a larger opening area per single spinning orifice than that of conventional general use, is employed, and the melt-spinning is performed under the conditions in which the relation between the opening area S ($mm^2$) of single spining orifice and the extruded quantity per single orifice Q (g/min.) satisfies the following formula (1), preferably the formula (2).

$$S \geqq 0.02\,Q^2 + 0.2 \quad (1)$$

$$S \geqq 0.1\,Q^2 + 0.2 \quad (2)$$

On the surface of the fiber obtained by melt-spinning the above-mentioned polyester under the conditions satisfying the formula (1), stretching the resulting fiber and subjecting the fiber to peeling treatment with a solvent or decomposing agent for the fiber, there are formed ridged microgrooves extending substantially continuously in the fiber axis direction (with a continuing length of more than 80 microns, especially more than 150 microns) and arranged nearly regularly. As a result, it is possible to obtain a polyester fiber improved not only in antistatic properties but also excellent in the dry touch feeling.

The stretching conditions in the present invention are not particularly limited, and any method may be employed as far as the the conditions lie within the following range:

| | |
|---|---|
| Stretch temperature | 70-200° C. |
| Stretch ratio | 1.5-6.0 times |

The thus-obtained stretched fiber is heat-set under stretching, and is woven or knit to form a fabric. Thereafter it is subjected to peeling treatment with a solvent or decomposing agent for the fiber, preferably with an alkali solution to peel off or dissolve away the fiber surface, thus decreasing the weight of the fiber.

The solvents or decomposing agents for the fiber used in the peeling treatment of the fiber in the present invention include for example, aqueous solutions of alkali compounds such as sodium hydroxide, potassium hydroxide, sodium carbonate, potassium carbonate, etc.; organic solvents such as chlorophenol, nitrobenzene, phenol, tetrachloroethane, etc.; alkylamines represented by monomethylamine, monoethylamine, normal propylamine, normal butylamine, isobutylamine, ethylenediamine, monoethanolamine, etc. and combinations of these with other organic solvents.

Among others, sodium hydroxide and potassium hydroxide are particularly preferable.

The concentration of the aqueous solution of such alkali compounds differs depending on the kind of alkali compounds, treating conditions, etc. However, a range from 0.01 to 4.0 weight % is usually favorable. The treating temperature is usually within the range of from room temperature to 100° C., and the treating time is usually within the range of from 1 minute to 4 hours. Suitable quantities to be removed by this treatment with an aqueous alkali solution are within the range of from 2 to 30 weight %, and among others, a quantity from 15 to 30 weight % is favorable, because such a quantity gives a good hand and dry touch feeling.

By such treatment with an aqueous alkali solution, there is formed the characteristic form of the surface of the polyester fiber of the present invention, that is, ridged microgrooves extending substantially continuously in the fiber axis direction and arranged nearly regularly, and microcraters having a width of from 0.05 to 0.4 micron, formed on the microgrooves and ridges of said ridged microgrooves.

The cross-sectional shape of the fiber of the present invention may be any of solid, hollow, non-circular, or non-circular hollow shape.

Figure 3:
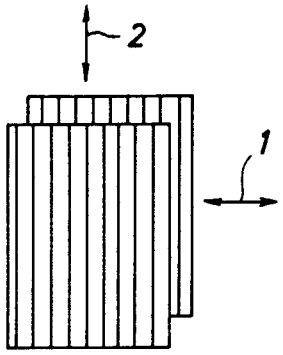
FIG. 3 is a picture showing the frictional directions (warp-warp, weft-weft) between cloths used for the evaluation of the present invention.
Figure 4:
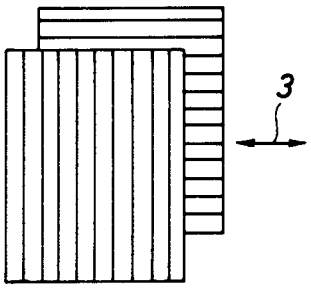
FIG. 4 is a picture showing the frictional direction (warp-weft) between cloths used for the evaluation of the present invention.

The dry touch feeling and hand of the fiber of the present invention are evaluated as follows:

The frictional anisotropy of the fiber is obtained by measuring the frictional force between cloth and cloth. When the cloth surface is composed mainly of warps as in the case of satin, crepe de chine, palace crepe, etc., the cloth is used as such. But when the cloth surface is composed of both warps and wefts as in the case of taffeta, habutae, etc., at the time of the final set, the cloth is pressed into the warp direction and stretch-set in the weft direction to increase the weave curvature of the warps so that the surface of the cloth can be composed mainly of warps. Measurement is made for the three cases of warp-warp, weft-weft, and warp-weft expressed by warps and wefts in the cloth arranged in the sliding direction and the direction at right angles to that direction, as shown in FIGS. 3 and 4.

Since the cloth surface is composed mainly of warps, the frictional characteristics of the cloth show the mutual frictional force between warps.

In the case of warp-warp is shown the frictional force when warps slide one on another in the direction at right angles to the fiber axis. This frictional force is a factor contributing to the feeling effect of the present invention. The higher this force, the cloth has a drier touch and a more creaking feel.

In the case of weft-weft is shown the frictional force when warps slide one on another in the fiber axis direction. This force participates in the cloth deformation resistance when the cloth is bent, and since it influences the resiliency of the cloth, the lower the weft-weft frictional force, the better is the resiliency.

In the case of warp-weft is shown the frictional force when the warps cross one over another at right angles. This force corresponds to the friction at the crossing points of the warps and wefts of the composing woven fabric, and participates in the drape properties. The lower the frictional force at the crossing points, the better is the drape. Therefore a lower warp-weft frictional force is preferable.

In the following, the present invention will be explained by way of Examples. However the present invention is not limited to and by these Examples, wherein percentages and parts are shown by weight unless otherwise noted. In the Examples, measurements of the half-life period of electric charge leakage (hereinafter merely called half-life period) and the light-resistance were made according to the following methods:

(1) Half-life period

Measurement of half-life period was made on a kitted product of filaments obtained, according to the method A (measurement of half-life period) defined in JIS-L-1094-1980 (testing method of antistatic properties of woven and knitted product). In order to evaluate the durability of antistatic properties, the filaments obtained were made into a knitted product, and after the following washing treatment and air drying, the product was used as a testing sample for the measurement of the half-life period.

The washing treatment was carried out by washing the knitted product with an aqueous solution of a neutral detergent (0.5 g/l) at 40° C. for 20 minutes by means of a home washing machine, dehydrating, rinsing with room temperature running water for 20 minutes, dehydrating again, rinsing with warm water at 40° C. for 5 minutes, these operations being repeated 20 times, followed by air drying.

(2) Light-resistance

The filaments obtained in the same way as above were made into a kitted product. The kitted product before and after the washing treatment was dyed with a dyeing solution of Lesolin Blue-FBL (disperse dye produced by Bayer AG)(1.0% owf; bath ratio 1:50) at 130° C. for 60 minutes in the usual way, subjected to reduction cleaning, and air-dried. The light-resistance of the thus-obtained product was measured by the method defined in JIS-0842-1971 (testing method of dyed color fastness against a carbon lamp).

(3) Frictional force between cloths

A test sample (cloth) was fixed horizontally on a flat board. Another same sample was fixed on a sliding block so that the warps or wefts could coincide with the sliding direction. The sliding face of the sliding block was a rectangle, 2 cm in the sliding direction and 1 cm in the direction at right angles to the sliding direction. The warps or wefts of the sample cloth on the flat board were fixed so that they could coincide with the sliding direction. The sliding block was placed so that it coud coincide with the sliding direction. A load of 50 g including the weight of the sliding block, was placed on the sliding block. The sliding block was drawn at a speed 2 cm per minutes. The stress caused at that time was measured. Measurement was made on the three combinations of warp-warp, warp-weft, and weft-weft expressed by the yarns in the sliding sliding direction and the direction at right angles to that direction, in the sample cloth on the flat board and the cloth on the sliding block.

(4) Deep color dyeability

A knit cloth after the peeling treatment was dyed with an aqueous dispersion of Dianix Black HG-FS (disperse dye produced by Mitsubishi Chemical Industries, Ltd.)(20% owf; bath ratio 1:100) at 130° C. for 60 minutes, and was subjected to reduction cleaning. The knit cloth was dried and was measured for its L-value by means of a Hunter color-difference meter. The lower the L-value, the deeper is the color.

(5) Dry touch

The dry touch was evaluated by touching a woven cloth after peeling treatment.

EXAMPLE 1

1000 parts of terephthalic acid, 787 parts of ethylene glycol, 1.8 parts of triethylamine and 0.4 part of antimony trioxide were charged in an autoclave. After replacing the air in the autoclave with nitrogen, esterification was conducted at a gage pressure of 2.5 kg/cm$^2$ at 240° C., while the generated water was continuously removed from the distillation tower. After 120 minutes from the beginning of the reaction, the pressure was released, and a product of an esterification ratio of 95% was obtained. To this product, 53.3 volume parts of an ethylene glycol solution of zirconyl acetate of a concentration of 0.1 mol/l were added (1,000 ppm calculated in terms of zirconium atom were added to the resulting polyester). Then, 0.8 volume part of an ethylene glycol solution of trimethyl phosphate of a concentration of 100 g/l (twice in mol for zirconium) was added. The reaction system was stirred at atmospheric pressure at this temperature (240° C.) for 10 minutes, and was then transferred to a polymerization-condensation tank. While the temperature of the reaction system was raised to 270° C. in 60 minutes, the pressure was gradually lowered to 0.1 mm Hg, and then polymerization-condensation was performed at this temperature and pressure for 100 minutes.

After the pressure was returned to atmospheric pressure with nitrogen, a melt mixture of polyethylene glycol (average molecular weight 20,000) with 1.0% 1,3,5-trimethyl-2,4,6-tris(3,5-ditertiarybutyl-4-hydroxybenzyl)benzene (antioxidant of the class of hindered phenol produced by Ciba Geigy, sold under the name of Irganox-1330) was added so that the polyethylene glycol content could become 2 weight %, and the polymerization was completed. A polyethylene glycol-containing polyester having a limiting viscosity ($\eta$) of 0.635 (measured at 30° C. in a mixed solvent of phenol and tetrachloroethane in the ratio of 6:4) was obtained. This polyester was spun by means of a melt extruder at a spinning temperature of 280° C. under the conditions shown in Table 1 to obtain yarns of 150 d/36 f. The yarns were stretched 3.0 times and stretched yarns of 50 d/36 f were obtained. From the yarns, a plain weave fabric of a warp density of 130 yarns/inch and a weft density of 86 yarns/inch was produced. After the fabric was refined and pre-set, it was treated in an aqueous solution of sodium hydroxide (60 g/l) at 90° C. for 57 minutes to obtain a fabric decreased 23% in weight. The fabric was dyed with an aqueous dispersion of Dianix Black HG-FS (disperse dye produced by Mitsubishi Chemical Industries, Ltd.)(20% owf; bath ratio 1:100) at 130° C. for 60 minutes, and then it was subjected to reduction cleaning. Thereafter, it was stretch-set at 160° C. for 60 minutes, and finally a finished fabric was obtained. This fabric was measured for the L-value by means of a Hunter color-difference meter and also the touch feel of the fabric was evaluated by 10 experts of polyester thin fabrics, according to five grades (the driest touch defined as grade 5; the waxy feel of regular polyester filament fabric as grade 1).

By the above-mentioned method, the fabric after peeling treatment was dyed and its light-resistance was judged. Also the half-life period of the fabric was determined. These data are sammerized in Table 1. From a scanning electron microscopic photograph (5,000 times magnfication) of this fabric, the number of ridged microgrooves extending continuously along the fiber axis and the average distance between adjacent microgrooves were measured. Also, from a photograph of 10,000 times magnification, was confirmed the presence or absence of microcraters (of which the largest width was 0.05–0.4 micron) on the surface of ridged microgrooves. From the finally obtained fabric which had been dyed and set, the frictional forces between cloths were also measured according to the above-mentioned method, and the results are shown in Table 1 (Experiment No. 1).

COMPARATIVE EXAMPLE 1

In the same manner as in Example 1 except that the blended quantity of polyethylene glycol (average molecular weight 20,000) was 0.1 weight %, a fabric was produced by way of trial. The results are shown in Table 1 as Experiment No. 2.

COMPARATIVE EXAMPLE 2

A fabric was produced by way of trial, in the same way as in Example 1 except that the blended quantity of polyethylene glycol (average molecular weight 20,000) was 8 weight %. The results are shown in Table 1 as Experiment No. 3.

When the blended quantity of polyethylene glycol exceeds 5 weight %, the antistatic properties are remarkably increased and the touch feel effect is also greatly improved, but the light-resistance becomes very bad and the fabric is not fit for practical use. In addition, the weight-decreasing speed at the time of dissolving-away with alkali is very great and the speed differs greatly from that of ordinary polyester. Accordingly, there are problems when such a fiber is blend-woven with ordinary polyester fiber. Moreover, deep color dyeing effect is not seen, because of possible generation of cavities inside the fiber.

COMPARATIVE EXAMPLE 3

A fabric was produced by way of trial in the same way as in Example 1 except that the ethylene glycol solution of zirconyl acetate and the ethylene glycol solution of trimethyl phosphate were not added. The results of evaluation of this fabric is shown in Table 1 as Experment No. 4.

Since the fabric made of the fibers has no microcraters of 0.05–0.4 micron on the ridged microgrooves, occurring from the internally grown particles, the touch feel effect is lowered, and no deep color dyeing effect is not seen especially in black-dyed fabric.

EXAMPLE 2

A fabric was produced in the same way as in Example 1 except that the orifice diameter of the spinneret was changed to 0.3 mm. The results of evaluation are shown in Table 1 Experiment No. 5.

When the spinneret orifice diameter becomes small and the shear speed of the flowing polymer in the orifice becomes fast and the spinning draft below the orifice becomes small, only few layers of blended polyethylene glycol continue in the form of microgrooves and the layers are cut into pieces, so that no continuous ridged microgrooves are obtained. As a result, although the dry touch feeling properties are somewhat improved, the effect is small, and the antistatic properties are not improved.

EXAMPLE 3

In the polymerization stage of Example 1, polyester was taken out without blending polyethyleme glycol, and a polyester polymer containing internally grown particles was obtained. Subsequently, 1000 parts of dimethyl terephthalate, 810 parts of 5-sodium sulfoisophthalic acid dimethyl ester, 1080 parts of ethylene glycol, and 1016 parts of the glycol represented by the following formula (3) were subjected to transesterification in the usual way and then to polymerization-condensation reaction, to obtain a polyester having a reduced viscosity of 0.40. Ten parts of this polyester and 90 parts of the above-mentioned polyester containing internally grown particles were chip-blended. Thereafter, in the same method as in Example 1, yarns were made and a fabric was produced therefrom. Evaluation was made and the results are shown as Experiment No. 6 of Table 1.

The thus-obtained fabric has substantially continuous ridged microgrooves and on said ridged microgrooves, secondary microcraters, of which the greatest width is 0.05–0.4 micron. This surface form gives frictional anisotropy to the fabric. This fabric is improved in feel and has sufficient dry touch. Thus this product attains the object of the present invention, but does not produce antistatic effect as in the case of the polyester blended with polyethylene glycol.

$$HO-(CH_2-CH_2-O)_m-CH_2-\underset{\substack{|\\ CH_3}}{\overset{\substack{CH_3\\ |}}{C}}-CH_2-O-(CH_2-CH_2-O)_n-H \quad (3)$$

wherein $m+n=5$ (average value).

EXAMPLE 4

A fabric was produced by way of trial in the same way as in Example 1 except that instead of adding ethylene glycol solutions of zirconyl acetate and trimethyl phosphate for the generation of internally grown particles, 676 parts of an ethylene glycol dispersion of calcium carbonate (average particle diameter 0.4 micron)(200 g/l) was added. The results of evaluation of this fabric are shown in Table 1 as Experimet No. 7.

In order to attain the object of the present invention, the invention makes it possible to introduce inert particles from the outside in addition to using internally grown particles for the purpose of giving on the fiber surface, substantially continuous ridged microgrooves and microcraters existing on said ridged microgrooves.

COMPARATIVE EXAMPLE 4

A fabric was produced by way of trial in the same way as in Example 1 except that polyethylene glycol (average molecular weight 20,000) was not added at the end of the polymerization. The results of the evaluation of this fabric are shown in Table 1 as Experiment No. 8.

Ridged microgrooves were formed uniformly on the fiber surface, but since they were uniform, the frictional anisotropy was little to produce little improving effect on the dry touch feeling. Moreover, the feeling characteristics such as resiliency and drape properties were insufficient.

COMPARATIVE EXAMPLE 5

A fabric was produced in the same way as in Example 1 except that 0.02 weight % of polyethylene glycol (average molecular weight 20,000) mixed and melted with 1.0% (1,3,5-ditertiary butyl-4-hydroxy-benzyl)-benzene (an antioxiddant of the class of hindered phenol), was used. The results of the evaluation of this fabric are shown in Experiment No. 9 of Table 1.

In the ridged microgrooves extending substantially continuously in the fiber axis direction and of which the distance between adjacent microgrooves satisfied 0.3–0.9 micron, the number of the microgrooves in the direction at right angles to the fiber axis was less than 3 per 10 microns. The antistatic properties were remarkably lowered. The frictional anisotropy on the fiber surface was also lowered, and especially the warp-warp frictional force became low. Moreover, the feeling effect became low.

COMPARATIVE EXAMPLE 6

A fabric was produced in the same way as in Example 1 except that the polyethylene glycol (average molecular weight 20,000) used in Comparative Example 5 was blended in a quantity of 15 weight %. The results of the evaluation of this fabric shown in Experiment 10 of Table 1.

The number of the ridged microgrooves substantially continuous in the fiber axis direction increased, and the number existing in the direction at right angles to the fiber axis on the fiber surface became more than 30 per 10 microns. The antistatic properties were remarkably increased, but the light-resistance was not sufficient. Furthermore, part of the fiber surface after the alkali treatment caused fibrillation, and therefore the durability to friction was inferior. The frictional anisotropy on the fiber surface was also lowered, probably because of the generated fibrils, to give a feel different from the dry touch feel, and the aimed silk-like hand was not obtained. Also as in the case of Comparative Example 2, deep color dyeing effect was not obtained.

COMPARATIVE EXAMPLE 7

Spinning and weaving were conducted in the same way as in Example 2 except that internally grown particles were not generated in the polyester by the addition of zirconium and phosphorus compounds, and that the quantity of polyethylene glycol was changed to 6 weight % based on the polyester. The results of the evaluation are shown in Experiment No. 11 of Table 1.

On the surface of the fiber obtained, there were ridged microgrooves which satisfied the distance between the adjacent microgrooves of 0.3–0.9 microm, but the number of substantially continuous ridged microgrooves formed was few. As a result, the feel improving effect was little. and the warp-warp frictional force between cloths was not high enough. Probably because of a cavity generated inside the fiber structure, the deep color dyeing effect was low and the light-resistance was not sufficient.

EXAMPLE 5

Spinning and weaving were performed in the same manner as in Example 1 except that, instead of adding internally grown particles, a silica dispersion in ethylene glycol containing silica particles (produced by Japan Aerosil Co. Ltd.; OX 50) in the ratio of 200 g/l was added to the polyester at the time of the completion of esterification so that the silica particle content in the polyester would be 3.0 weight %, based on the polyester. The results of the evaluation are shown in Experiment No. 12 of Table 1.

The feeling properties, deep color dyeability and hand touch were sufficient and the antistatic properties were also good.

Thus, according to the present invention, a polyester synthetic fiber is provided which satisfies dry touch feel, silk-like hand, and excellent deep color dyeability at the same time, and which, if necessary, is provided with a high degree of antistatic properties. These property improvements of polyester fiber have not been attained by prior techniques.

TABLE 1

| Experiment no. | Open area S | Extrusion per orifice Q g/min | Shear speed $\tau w$ $sec^{-1}$ | Winding speed m/min | Spinneret draft VL/Vo | Before washing: Half-life period (second) | Before washing: Light-resistance (grade) | After washing 20 times: Half-life period (second) | After washing 20 times: Light-resistance (grade) |
|---|---|---|---|---|---|---|---|---|---|
| 1 | 0.75 | 0.6 | 90.2 | 1300 | 1950 | 41 | 4–5 | 55 | 4–5 |
| 2 | 0.75 | 0.6 | 90.2 | 1300 | 1950 | 300< | 4–5 | 300< | 4–5 |
| 3 | 0.75 | 0.6 | 90.2 | 1300 | 1950 | 20 | 3–2 | 25 | 2–1 |
| 4 | 0.75 | 0.6 | 90.2 | 1300 | 1950 | 42 | 4–5 | 56 | 4–5 |
| 5 | 0.07 | 0.6 | 3143.8 | 1300 | 151.7 | 278 | 4–5 | 300< | 4–5 |
| 6 | 0.75 | 0.6 | 90.2 | 1300 | 1950 | 300< | 4–5 | 300< | 4–5 |
| 7 | 0.75 | 0.6 | 90.2 | 1300 | 1950 | 58 | 4–5 | 65 | 4–5 |
| 8 | 0.75 | 0.6 | 90.2 | 1300 | 1950 | 300< | 4–5 | 300< | 4–5 |
| 9 | 0.75 | 0.6 | 90.2 | 1300 | 1950 | 300< | 4–5 | 300< | 4–5 |
| 10 | 0.75 | 0.6 | 90.2 | 1300 | 1950 | 21 | 2–1 | 23 | 2–1 |
| 11 | 0.07 | 0.6 | 3143.8 | 1300 | 151.7 | 180 | 2–1 | 300< | 2–1 |
| 12 | 0.75 | 0.6 | 90.2 | 1300 | 1950 | 57 | 4–5 | 59 | 4–5 |

| Evaluation of feel (Grade) | Number of ridged microgrooves per 10μ*: Length more than 80μ | Number of ridged microgrooves per 10μ*: Length less than 80μ | Presence of microcraters** | Cloth-cloth frictional force (g): Warp-warp | Cloth-cloth frictional force (g): Warp-weft | Cloth-cloth frictional force (g): Weft-weft | L value of a black-dyed Cloth |
|---|---|---|---|---|---|---|---|
| 5 | 18.2 | 2.0 | yes | 52 | 20 | 22 | 13.5 |
| 4 | 5.2 | 1.8 | yes | 32 | 20 | 22 | 13.8 |
| 5 | 23.2 | 2.2 | yes | 55 | 20 | 23 | 14.2 |
| 3 | 19.2 | 1.6 | no | 48 | 22 | 25 | 14.5 |
| 4 | 2.3 | 18.2 | yes | 38 | 19 | 21 | 13.5 |
| 5 | 15.3 | 2.2 | yes | 51 | 20 | 21 | 13.3 |
| 5 | 17.2 | 1.9 | yes | 50 | 20 | 20 | 13.4 |
| 4 | 0.0 | 19.8 | yes | 28 | 20 | 21 | 13.5 |
| 4 | 1.2 | 0.8 | yes | 30 | 20 | 21 | 13.8 |
| 3 | 41.0 | 9.2 | yes | 29 | 21 | 24 | 14.5 |
| 3 | 1.8 | 16.2 | no | 32 | 22 | 23 | 14.2 |
| 5 | 12.5 | 1.8 | yes | 51 | 19 | 21 | 13.2 |

*Number of ridged microgrooves satisfying an average distance of 0.3–0.9 micron between centers of adjacent microgrooves in the circumferential direction at right angles to the fiber axis.
** Microcraters on ridged microgrooves.

What we claim is:

1. A polyester synthetic fiber containing polyoxyalkylene glycol or a derivative thereof in a quantity of 0.5–5 weight %, and internally grown particles generated from a phosphorus compound and a zirconium compound in a quantity of 80–2500 ppm calculated in terms of a zirconium atom; characterized by ridged microgrooves formed on the whole surface of the fiber wherein the length of a microgroove is at least 80 microns and which microgrooves extend substantially continuously in the axial direction of the fiber and are arranged nearly regularly, the distance between the respective substantially longitudinal center lines of adjacent microgrooves being 0.3–0.9 micron as measured as a flat distance along the circumferential direction at right angles to the fiber axis, the microgrooves existing 7–30 in number per 10 microns of the plane distance along the circumference at right angles to the fiber axis, there being distributed microcraters on the ridges and microgrooves, said microcraters having a width of 0.05–0.4 micron.

2. The polyester synthetic fiber as claimed in claim 1 wherein the content of the internally grown particles generated from a phosphorus compound and a zirconium compound is 200–1500 ppm calculated in terms of a zirconium atom.

3. The polyester synthetic fiber as claimed in claim 1 wherein the length of a microgroove is at least 150 microns.

4. The polyester synthetic fiber as claimed in claim 1 wherein the length (D) in the widthwise direction and the length (L) in the fiber axis direction of a microcrater existing on a ridged microgroove form a L/D ratio of less than 10.

5. The polyester synthetic fiber as claimed in claim 4 wherein the depth of a microcrater existing on a ridged microgroove is 0.8–1.5 times the width of said microcrater.

* * * * *